US005099547A

United States Patent [19]

Salice

[11] Patent Number: 5,099,547

[45] Date of Patent: Mar. 31, 1992

[54] MOUNTING PLATE ASSEMBLY FOR A HINGE

[75] Inventor: Luciano Salice, Carimate, Italy

[73] Assignee: Arturo Salice S.p.A., Novedratese, Italy

[21] Appl. No.: 632,385

[22] Filed: Dec. 26, 1990

[30] Foreign Application Priority Data

Dec. 29, 1989 [DE] Fed. Rep. of Germany ..... 3943330

[51] Int. Cl.[5] ..... E05D 7/06

[52] U.S. Cl. ..... 16/239; 16/249

[58] Field of Search ..... 16/239, 249, DIG. 43

[56] References Cited

U.S. PATENT DOCUMENTS 4,653,144 3/1987 Lautenschlager, Jr. ..... 16/239

*Primary Examiner*—Robert L. Spruill
*Assistant Examiner*—Carmine Cuda
*Attorney, Agent, or Firm*—Fleit, Jacobson, Cohn, Price, Holman & Stern

[57] ABSTRACT

This invention relates to a mounting plate assembly for a hinge, preferably for a furniture hinge, comprising a base plate and an intermediate plate, which is adjustable relative to the base plate and is adapted to be clamped against or connected to the base plate by a screw in different adjusted positions and on which the hinge bracket is preferably adjustably mounted. To provide a mounting plate assembly which is of the kind described first hereinbefore and which can be used to secure hinges of conventional type to carrying walls of furniture or the like in such a manner that the doors or flaps mounted by means of the mounting plate assembly will include with the carrying wall an angle differing from 90 degrees when the door or flap is in its closed position, the base plate and the intermediate plate bear on each other on mutually complementary, cylindrically curved bearing surfaces having axes of curvature which are transverse to the plates so that the plates can be adjusted in a common center plane, which is approximately at right angles to the plates, to a plurality of positions, in which the plates include different angles with each other, and the plates can be clamped against or secured to each other in any of the positions.

7 Claims, 4 Drawing Sheets

MOUNTING PLATE ASSEMBLY FOR A HINGE

BACKGROUND OF THE INVENTION

1. Field of the Invention

This invention relates to a mounting plate assembly for a hinge, preferably for a furniture hinge, comprising a base plate and an intermediate plate, which is adjustable relative to said base plate and is adapted to be clamped against or connected to the base plate by a screw in different adjusted positions and on which the hinge bracket is preferably adjustably mounted.

2. Description of the Prior Art

For an adjustment of inevitable manufacturing tolerances and inaccuracies in assembling it is desired to permit an adjustment of furniture hinges after they have been mounted. For that purpose the hinge should be adjustable in the direction of the depth of the furniture and in a lateral direction and, if possible, also in the direction of the height of the furniture. Furniture hinges are usually connected to the rear surface of a door leaf by a cuplike hinge member, which is coupled by a linkage to a hinge bracket, which in modern hinges is held to be adjustable in the direction of two or three coordinate axes on a mounting plate, which is secured to the inside surface of a carrying wall of a piece of furniture.

A mounting plate assembly which permits an adjustment of a hinge bracket in the directions of three coordinate axes has been disclosed, e.g., in Published German Application 38 41 405.

In the use of the conventional furniture hinges it is assumed that in their closed position they hold a door or flap in an orientation at an angle of 90 degrees to the carrying wall of the piece of furniture. But there are more and more special pieces of furniture in which a door or flap in its closed position includes with the carrying wall an angle differing from 90 degrees. Because conventional standard hinges cannot be used in such cases, hinges must be manufactured which are suitable for the desired angle or special hardware must be used, which may consist, e.g., of wedge-shaped shims.

German Utility Model 83 13 305 discloses a wedge-shaped fixture which can be used to secure the mounting plate of a piece of furniture to a carrying wall of the furniture at an angle which corresponds to the angle of the wedge so that the door which is mounted by means of the hinge will include an angle in excess of 90 degrees with the carrying wall when said door is in its closed position. But the mounting and adjustment of such wedge-shaped shims is relatively work-consuming and complicated.

To permit a door to be mounted on a carrying wall so that the door includes with the carrying wall an angle differing from 90 degrees when the door is in its closed position, a special hinge bracket has been provided, which has been disclosed in Published German Application 32 17 104 and which in its forward end portion is pivoted to a hinge carrier, which can be fixed in different angular positions relative to the hinge bracket.

Published German Application 35 11 493 discloses a curved hinge bracket, which can be secured to a holding arm, which is secured to the carrying wall and has a corresponding curvature so that a door can be mounted to include in its closed position an angle differing from 90 degrees with the carrying wall.

But the two hinge brackets described last can only be used in specially designed hinges, which are usually required only in small quantities so that they are uneconomical and expensive and it is also expensive to keep the assorted hinges separately in stock.

SUMMARY OF THE INVENTION

For this reason it is an object of the invention to provide a mounting plate assembly which is of the kind described first hereinbefore and which can be used to secure hinges of conventional type to carrying walls of furniture or the like in such a manner that the doors or flaps mounted by means of said mounting plate assembly will include with the carrying wall an angle differing from 90 degrees when the door or flap is in its closed position. It is also desired that the angle between the door and the carrying wall can infinitely be adjusted within a large range in a simple manner.

In a mounting plate assembly of the kind described first hereinbefore that object is accomplished in accordance with the invention in that the base plate and the intermediate plate bear on each other on mutually complementary, cylindrically curved bearing surfaces having axes of curvature which are transverse to the plates so that the plates can be adjusted in a common center plane, which is approximately at right angles to the plates, to a plurality of positions, in which said plates include different angles with each other, and said plates can be clamped against or secured to each other in any of said positions. Whereas in the use of known mounting plate assemblies the intermediate plate is adjustable relative to the base plate for an adjustment of the hinge in the direction of the depth or height of the furniture or in the lateral direction, the intermediate plate of the mounting plate assembly in accordance with the invention is slidably guided on the base plate by means of curved bearing surfaces so that the intermediate plate can be pivotally moved relative to the base plate for an adjustment of the angle included by the door or flap with the carrying wall in the closed position of the door or flap and the intermediate plate can be connected to the base plate in any selected relative angular position.

The intermediate plate of the mounting plate assembly in accordance with the invention is so designed that conventional hinge brackets of standard hinges can be secured to the intermediate plate. For instance, as regards the ways in which the hinge bracket can be secured to the intermediate plate the latter may be designed like the mounting plate which is known from German Patent Specification 34 26 672 so that hinge brackets can adjustably be fixed thereto by means of screws or by a snap-action joint.

Desirably, the intermediate plate has on its bottom a concavely curved bearing surface and the base plate has on its top a convexly curved bearing surface. It will be understood that the arrangement of the coacting bearing surfaces may be inverted.

The radius of curvature of the concavely curved bearing surface may be smaller than the radius of curvature of the convexly curved bearing surface so that those portions of the bearing surfaces which contact each other can be clamped against each other to eliminate backlash.

In accordance with a further feature of the invention the base plate is provided on its bottom with a groove, which is radial relative to the curved bearing surface, the base plate is formed at the bottom of the groove with a slot, which extends through the bearing surface and is narrower than the groove, a nut is longitudinally slidably guided in the groove and has mutually opposite parallel side faces, which can bear on the side faces of the groove with a play, and a screw is screwed into the nut and extends through a bore in the curved bearing surface of the intermediate plate. In that case the nut virtually constitutes a slider, which is guided in the groove and supported on the steplike surfaces of the groove and can be used to clamp the plates against each other in various adjusted angular relative positions.

The intermediate plate may be provided with laterally protruding pins, which are guided in lateral guide grooves or on lateral guide edges or guide ribs of the base plate, which guide grooves, guide edges or guide ribs are curved about the same axis of curvature as the bearing surface. It will be understood that the arrangement of the pins and guides may be inverted.

In accordance with a further feature of the invention the curved bearing surfaces extend only over part of the length of the base plate and intermediate plate, respectively. As the intermediate plate is pivotally moved relative to the base plate for an angular adjustment, the intermediate plate will perform also a translational movement and the extent of that translational displacement can be decreased in that the curved bearing surfaces are designed to have a correspondingly smaller radius of curvature. The displacement which results from the angular adjustment will be taken into account as the base plate is mounted on the carrying wall because that displacement will always be the same for a given angular adjustment.

DETAILED DESCRIPTION OF THE PREFERRED EMBODIMENTS

Figure 1:
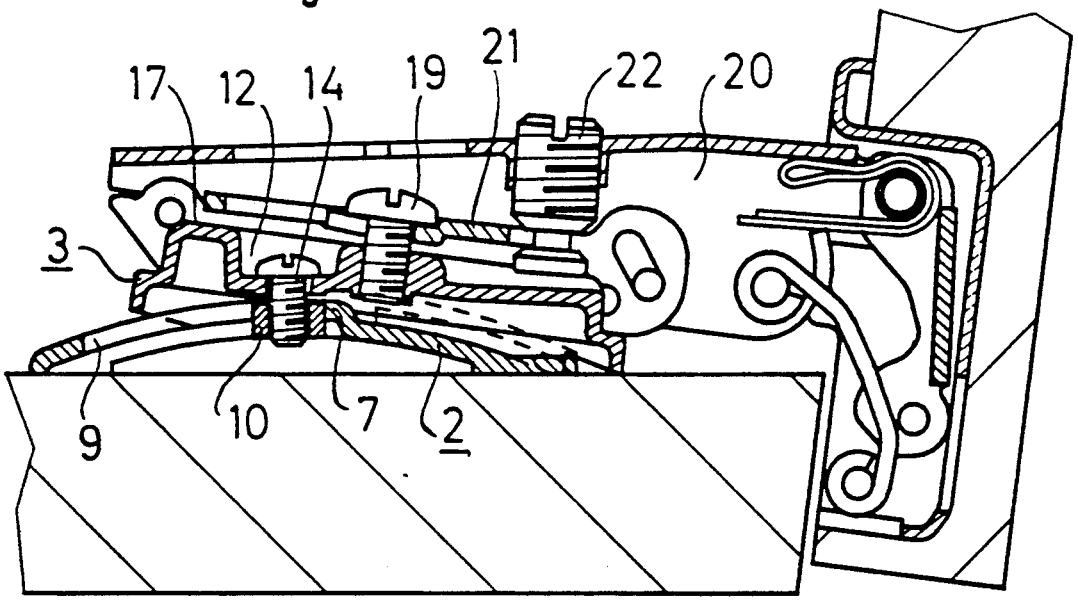
FIG. 1 is a longitudinal sectional view showing a hinge, which comprises a mounting plate assembly, which is so adjusted that the door will include the largest possible angle with the carrying wall in the closed position of the door.

Illustrative embodiments of the invention will now be described more in detail with reference to the drawing.

In the illustrative embodiment shown in FIGS. 1 to 6 the mounting plate assembly 1 comprises the base plate 2 and the intermediate plate 3. The base plate has an intermediate portion 4, which in a top plan view is elongate and substantially rectangular and has a convex cylindrical curvature as is indicated by the line 5 in FIG. 3. The intermediate plate 3 is provided on its bottom with a bearing surface 6, which has a complementary convex curvature.

Figure 2:
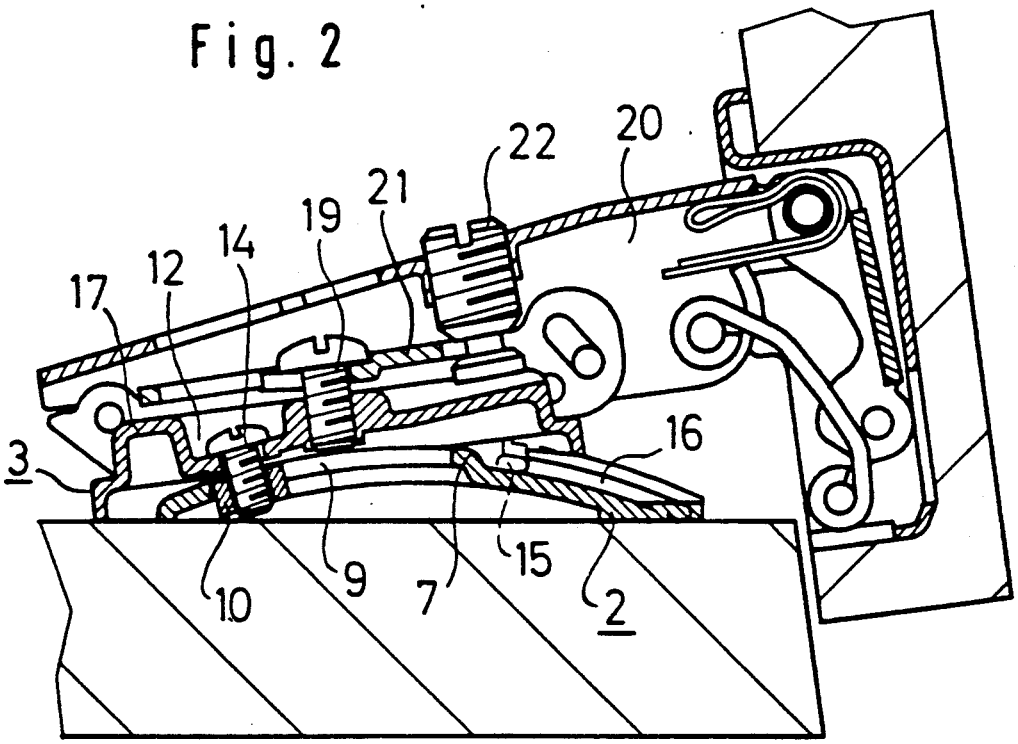
FIG. 2 is a sectional view which is similar to FIG. 1 and shows a hinge comprising a mounting plate assembly which is so adjusted that the door in its closed position will include the smallest possible angle with the carrying wall.
Figure 3:
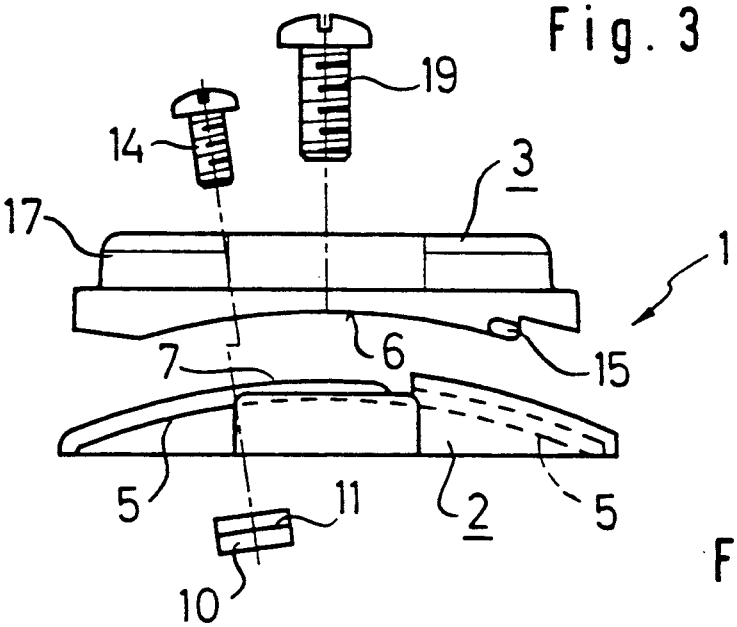
FIG. 3 is an exploded side elevation showing the base plate and intermediate plate of the mounting plate assembly.
Figure 4:
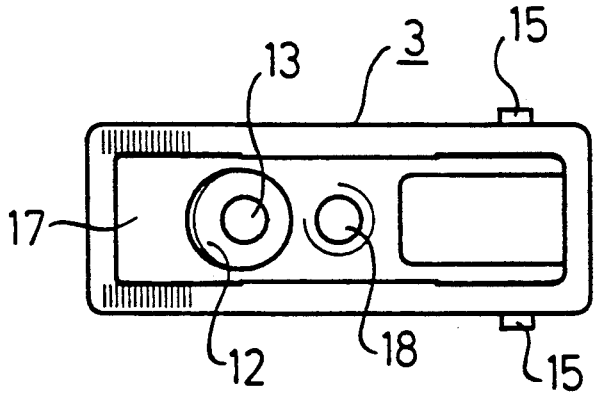
FIG. 4 is a top plan view showing the intermediate plate.
Figure 5:
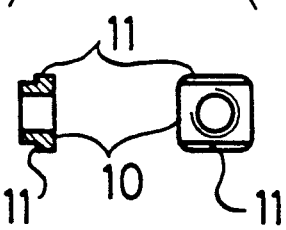
FIG. 5 is a top plan view and a sectional view showing the sliding nut.
Figure 6:
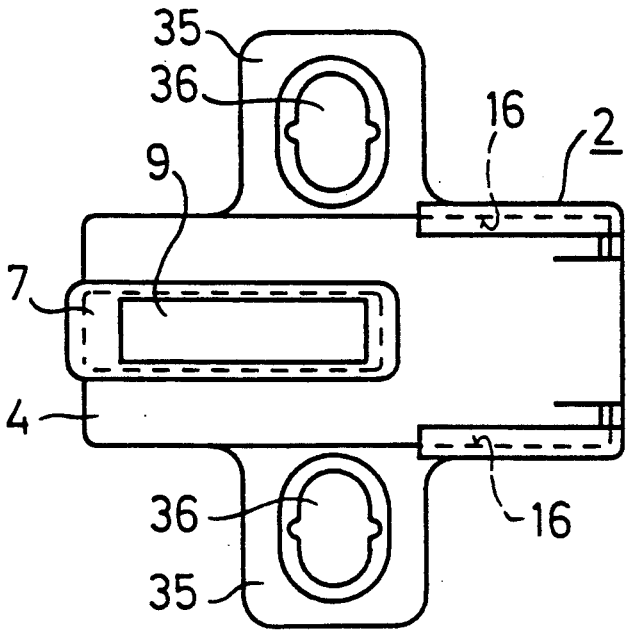
FIG. 6 is a top plan view showing the base plate.

A recess is formed between the convexly curved cylindrical bearing surfaces 6 of the intermediate plate 3. That recess receives the ramplike curved elevation 7, which is formed on the base plate in an intermediate portion of the bearing surface 4 of the base plate, as is apparent from FIGS. 3 and 6. The ramplike elevation 7 is provided with a rectangular slot 9 indicated in FIG. 6. That slot 9 is formed in the bottom of an open-bottomed, curved groove formed in the base plate 2. The sliding nut 10 is guided in that groove. The sliding nut 10 is four-cornered in a top plan view and is formed on mutually opposite sides with steps 11, with which the sliding nut 10 bears on the edges of the slot 9. The recessed side face portions of the sliding nut 10 are held against rotation between the side faces of the slot 9. The intermediate plate 3 has a recess 12 and at the bottom of that recess is formed with a bore 13 for receiving a clamp screw 14, which is screwed into the sliding nut 10, as is indicated in FIGS. 1 and 2.

The intermediate plate 3 is provided in its forward portion with mutually opposite, protruding pins 15, which are guided in lateral grooves 16 of the base plate 2.

In an intermediate portion the intermediate plate 3 is provided with a pedestallike elevation 17, which in an intermediate portion is formed with a tapped bore 18, into which a fixing screw 19 can be screwed, which serves to secure a hinge bracket or another intermediate plate for carrying a hinge bracket.

The top surface of the intermediate plate 3 is so designed that conventional standard hinge brackets of hinges can be secured to that top surface.

In the hinge shown in FIGS. 1 and 2 another intermediate plate 21, which carries a hinge bracket 20, is fixed to the mounting plate assembly 1 by means of a fixing screw 19. The hinge bracket 20 and the further intermediate plate 21 are designed as described in Published German Application 38 41 405 with reference to FIG. 2 thereof. The further intermediate plate 21 might be connected to the underlying intermediate plate by a snap-action joint. But in the embodiment shown in FIGS. 1 and 2 the intermediate plate 21 is screw-connected to the intermediate plate 3 in the manner which has been described in Published German Application 38 41 405 as an alternative.

The use of the further intermediate plate which has been described in Published German Application 38 41 405 and of a hinge bracket which is pivoted to that intermediate plate will afford the special advantage that by an actuation of the adjusting screw 22 the hinge bracket 20 can be pivotally moved relative to the further intermediate plate 21 and that pivotal adjustment may additionally be effected for an adjustment of the angle between the hinge bracket 20 and the carrying wall.

In the illustrative embodiment shown in FIGS. 7 to 13 the base plate 25 and the intermediate plate 26 are formed with cylindrically curved bearing surfaces 27, 28 only over part of their length. Because the bearing surfaces 27, 28 have a smaller radius of curvature, the intermediate plate 26 during its pivotal adjustment on the base plate 25 will perform only a smaller translational movement in the longitudinal direction.

In the second embodiment, the base plate 25 and the intermediate plate 26 are adapted to be clamped against each other in the adjusted angular positions by a sliding nut 30 and a clamp screw 31 as in the embodiment shown in FIGS. 1 to 6.

The intermediate plate 26 is again provided with laterally protruding pins 32, which interlock with arcuately curved ribs 33 on side portions of the base plate 25.

The base plates 2 and 25 are provided with laterally attached wings 35, which have slots 36, which are used to secure the base plates to carrying walls in vertically adjustable positions by means of suitable fixing screws.

Figure 7:
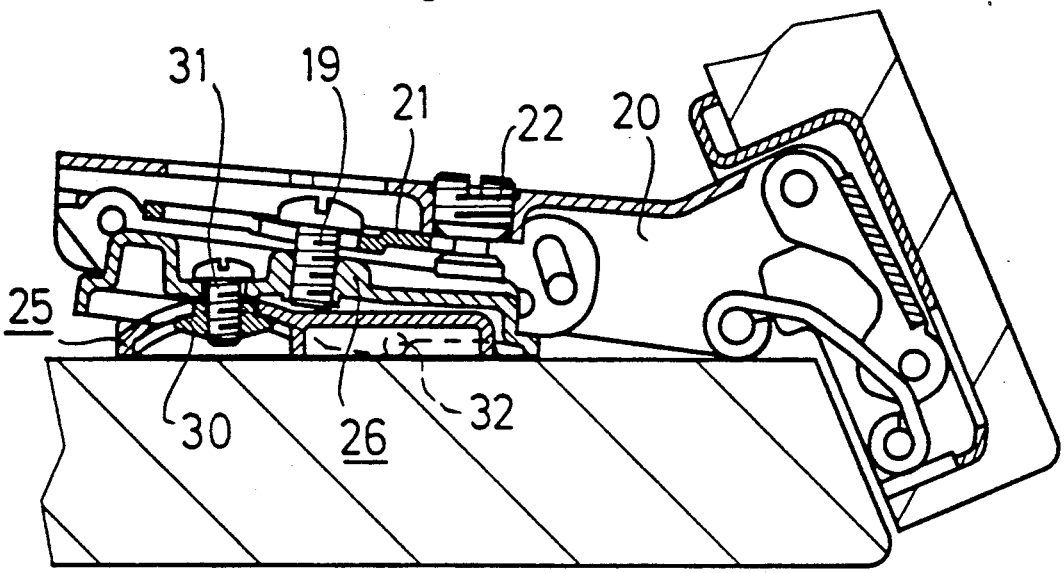
FIG. 7 is a sectional view which is similar to FIG. 1 and shows a second embodiment of a hinge that comprises a mounting plate assembly.
Figure 8:
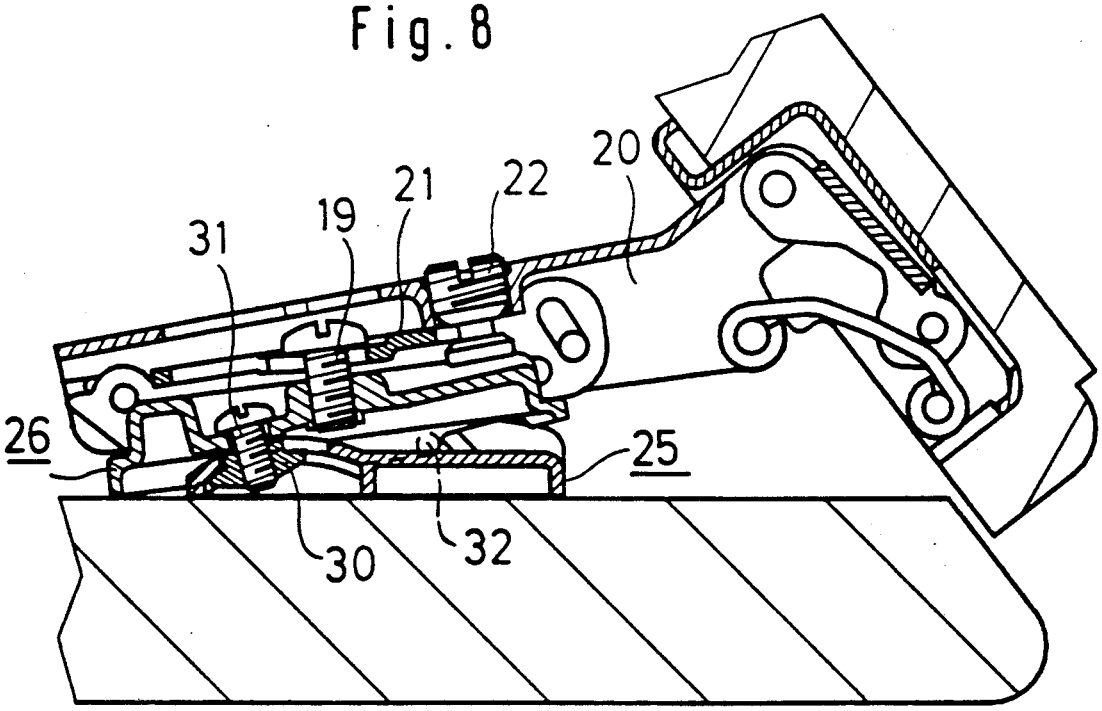
FIG. 8 is a sectional view which is similar to FIG. 7 and shows the adjustment corresponding to the smallest angle.
Figure 9:
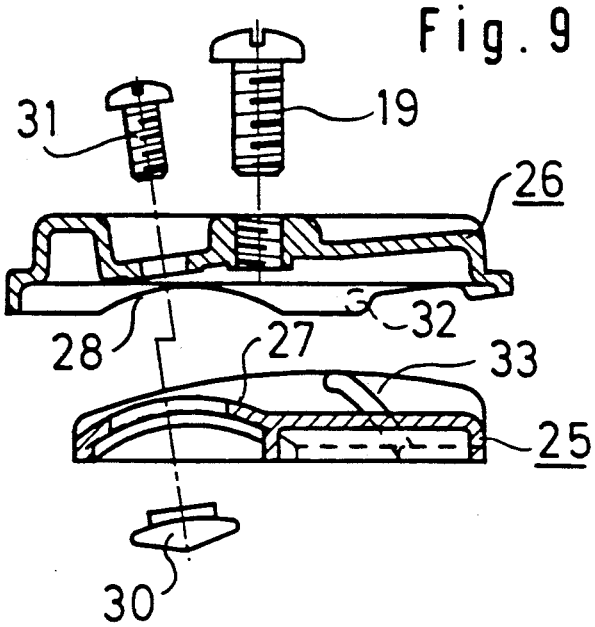
FIG. 9 is an exploded sectional view showing the components of the mounting plate assembly of FIGS. 7 and 8.
Figure 10:
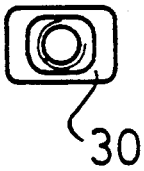
FIG. 10 is a top plan view showing the sliding nut of FIGS. 7 to 9.
Figure 11:
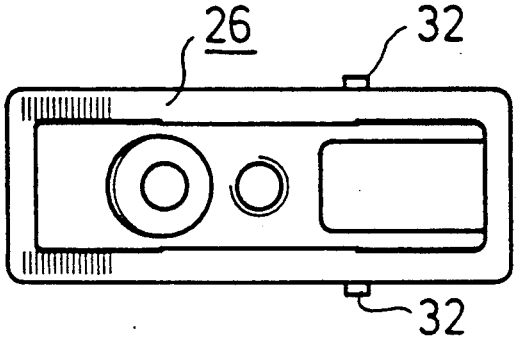
FIG. 11 is a top plan view showing the intermediate plate.
Figure 13:
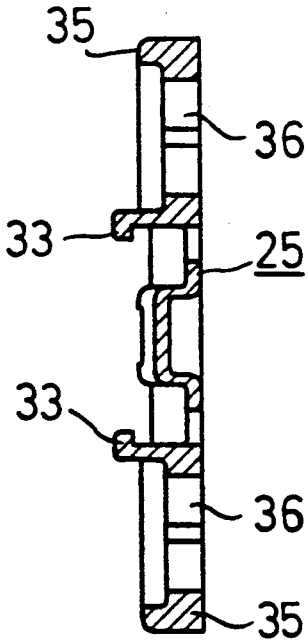
FIG. 13 is a sectional view taken on line XIII—XIII in FIG. 12.
Figure 12:
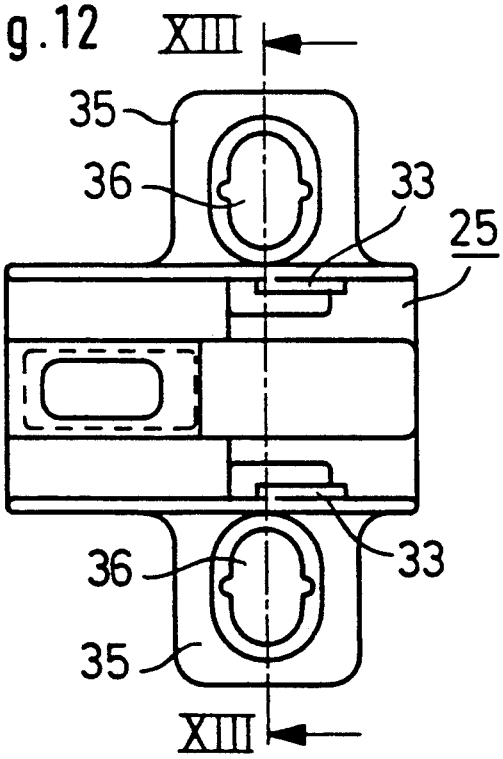
FIG. 12 is a top plan view showing the base plate.

As is apparent from FIGS. 7 and 8, an additional intermediate plate is secured to the intermediate plate 26 by a fixing screw 19 in the manner shown in FIGS. 1 and 2 and is adjustably and pivotally connected to the hinge bracket.

I claim:

1. A mounting plate assembly for a hinge, comprising a base plate and an intermediate plate, which is adjustable relative to said base plate and is adapted to be clamped against or connected to the base plate by a screw in different adjusted positions and on which a separate hinge bracket is mounted, characterized in that the base plate and the intermediate plate bear on each other on mutually complementary, cylindrically curved bearing surfaces having axes of curvature which are transverse to the plates so that the plates can be adjusted in a common center plane, which is approximately at right angles to the plates, to a plurality of positions, in which said plates include different angles with each other, and said plates can be clamped against or secured to each other in any of said positions.

2. A mounting plate assembly according to claim 1, characterized in that the intermediate plate has on its bottom a concavely curved bearing surface and the base plate has on its top a convexly curved bearing surface.

3. A mounting plate assembly according to claim 1 or 2, characterized in that the radius of curvature of a concavely curved bearing surface is slightly smaller than the radius of curvature of a convexly curved bearing surface so that the surfaces becomes mutually complementary when clamped together.

4. A mounting plate assembly according to claim 1, characterized in that the base plate is provided on its bottom with a groove, which is radial relative to the curved bearing surface, the base plate is formed at the bottom of the groove with a slot, which extends through the bearing surface and is narrower than the groove, a nut is longitudinally slidably guided in the groove and has mutually opposite parallel side faces, which can bear on the side faces of the groove with a play, and a screw is screwed into the nut and extends through a bore in the curved bearing surface of the intermediate plate.

5. A mounting plate assembly according to claim 1, characterized in that the intermediate plate is provided with laterally protruding pins, which are guided in lateral guide grooves or on lateral guide edges or guide ribs of the base plate, which guide grooves, guide edges or guide ribs are curved about the same axis of curvature as the bearing surface.

6. A mounting plate assembly according to claim 1, characterized in that the curved bearing surfaces extend only over part of the length of the base plate and intermediate plate, respectively.

7. A mounting plate assembly according to claim 1, further comprising means for adjusting the mounting of the separate hinge bracket on the intermediate plate.

* * * * *